US005732620A

United States Patent [19]

Christy et al.

[11] Patent Number: 5,732,620

[45] Date of Patent: Mar. 31, 1998

[54] STALLED SHEET PULLING AND CRUSHING APPARATUS IN AN ELECTROSTATOGRAPHIC MACHINE

[75] Inventors: Kenneth G. Christy, Webster; Murray O. Meetze, Jr., Rochester; Arthur H. Kahn, Cohocton; Thomas P. Lambert, Webster, all of N.Y.

[73] Assignee: Xerox Corporation, Stamford, Conn.

[21] Appl. No.: 837,028

[22] Filed: Apr. 11, 1997

[51] Int. Cl.[6] ..... B30B 3/02; G03G 15/00

[52] U.S. Cl. ..... 100/80; 100/156; 100/159; 399/21; 399/124; 399/381; 399/411

[58] Field of Search ..... 100/76, 80, 155 R, 100/156, 159, 161, 166, 173, 210; 399/21, 124, 381, 411; 493/405, 407

[56] References Cited

U.S. PATENT DOCUMENTS

| | | | |
|---|---|---|---|
| 4,990,966 | 2/1991 | Sindo | 399/124 |
| 5,255,061 | 10/1993 | Matsuura et al. | 399/124 |
| 5,652,942 | 7/1997 | Iseki et al. | 399/21 |

OTHER PUBLICATIONS

Kurtz, Robert L. et al., "Paper Eject Baffle", *Xerox Disclosure Journal*, vol. 8, No. 4, Jul./Aug. 1983, pp. 297–298.

*Primary Examiner*—Stephen F. Gerrity
*Attorney, Agent, or Firm*—Tallam I. Nguti

[57] ABSTRACT

In a sheet handling machine having a frame, and a cut sheet handling system including a sheet path, a stalled sheet pulling and crushing apparatus for reducing a sheet, stalled across an interface between a withdrawable and a fixed component of a cut sheet handling system into a shape and size suitably enabling reliable removal of the stalled sheet through a relatively narrow gap between the withdrawable and fixed components of the sheet handling system. The stalled sheet pulling and crushing apparatus includes a fixed component of the sheet handling system connected to a frame of the machine and having a first sheet gripping nip forming a first section of a sheet path; a withdrawable component of the sheet handling system mounted movably to the frame, and having a sheet flattening side defining a relatively narrow gap between a fixed surface within the machine and the withdrawable component, the withdrawable component including a second sheet gripping nip forming a second section of the sheet path for adjoining the first section of the sheet path; and a movable sheet pulling device comprising a rotatable roller mounted to the fixed surface and projecting partially into the narrow gap for contacting and rotatably applying a sheet pulling force on the stalled sheet in a first direction to pull an end of the stalled sheet out of the first sheet gripping nip, as the withdrawable component is being pulled in a second and different direction relative to the first direction. The rotatable roller as mounted cooperating with the sheet crushing side of the withdrawable component to accordion fold and crush the pulled out stalled sheet without a tear, into a shape and size suitably enabling reliable removal of the stalled sheet through the narrow gap.

5 Claims, 3 Drawing Sheets

STALLED SHEET PULLING AND CRUSHING APPARATUS IN AN ELECTROSTATOGRAPHIC MACHINE

RELATED CASE

This application is related to U.S. application Ser. No. (Applicants' Docket No. D/96775) entitled "A STALLED SHEET FOLDING AND FLATTENING APPARATUS IN AN ELECTROSTATOGRAPHIC MACHINE" filed on even date herewith and having common inventors.

BACKGROUND

This invention relates generally to electrostatographic reproduction machines using copy sheets, and more particularly, to apparatus for pulling and crushing a stalled sheet so as to enable its effective removal from a relatively narrow gap between machine components.

In a typical electrostatographic reproduction process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document.

After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive or image bearing member. The toner powder image is then transferred at an image transfer station, from the photoconductive member, to a copy substrate such as a copy sheet of paper. Thereafter, heat or some other treatment is applied to the toner particles at a fusing station to permanently fuse and affix the toner powder image to the copy sheet or substrate.

The copy sheet or substrate typically is fed automatically from a stack supply thereof, along a sheet transport path that includes a sheet registration subassembly, to the image transfer station where the toner image is transferred from the image bearing member onto a first side of the copy sheet. As discussed above, after such toner image transfer, the copy sheet is moved along the sheet path to the fusing station of the machine where the toner image is fused and affixed to the copy sheet. In machines with duplex copying capability, the sheet path usually includes a sheet inverter, and the copy sheet after leaving the fusing station, is inverted at the inverter and refed to the transfer station in proper orientation for receiving a second toner image on a second side of the copy sheet. In either case, the copy sheet with the fused toner image or images on it is then forwarded to an output tray or finishing station.

High quality output copies typically require proper and high quality registration of the toner image or images on the copy sheet. To achieve such registration, the copy sheet must be transported in a timed and registered manner to the sheet registration subassembly and to the transfer station each time, and sheet drive mechanisms along the sheet path have to function without slippage. Presence and proximity sensors can be used for assisting the achievement of such proper and timed registration of each copy sheet.

Typically, any failure of a copy sheet being transported along the sheet path to activate any of the above sensors at a control point, in time or space, usually registers as a machine error. Detection of such an error usually results a copy sheet stall or jam along the sheet path, as well as in a machine shutdown, and in a call or alert for an operator to remove or clear the stalled or jammed copy sheet, wherever it may be, along the sheet transport path.

"Works in a drawer" sheet handling subsystems in sheet handling machines are often favored because of the benefits they offer for clearing jammed or stalled sheets contained entirely within the subsystem. Such drawer designs are particularly employed for electrostatographic machine subsystems such as fuser and post-fuser sheet inverter subsystems that ordinarily include hidden sheet paths that are hard or unsafe to access. With such designs, subsystems such as the fuser, inverter, duplex and/or registration transports are mounted on a drawer or platform on rails and slides which enable the subsystem(s) to be pulled out of, and pushed back into the machine. Typically, each such subsystem is made movable in and out of the machine, relative to other fixed portions or components of the machine. As higher and higher speed machines are made to have a smaller and smaller footprint, the gap or interface between withdrawable subsystems and fixed components are becoming narrower and narrower.

Unfortunately, sheets moving through and across such an interface between a withdrawable module and a fixed portion or component of the machine, can become jammed or stalled across such interface. Where as disclosed, for example in Xerox Disclosure Journal, Vol. 8, No. 4, July/August 1983, there is sufficient open space within the machine above or below the withdrawable component or module, a simple contoured ramp can be used to deflect a loose end of the stalled sheet into such open space. Such a simple ramp however will not work where there is only a narrow gap and no such open space. It also will not work in a case where the stalled sheet is within the grip of a nip at both the withdrawable module side. Clearing a stalled or jammed sheet in each of these cases presents very unique problems, which often can include preventing the withdrawable module from being movable in or out of the machine. These sheets will often catch, tear, or wad up between the moving subsystem and stationary subsystem (or machine frame). This ordinarily increases the force required to pull out the drawer, as well as the potential for a complete shutdown, and for torn sheets which are left in the sheet or paper path.

Ordinarily, when the withdrawable module is prevented from being movable in or out of the machine as such, any further attempts to forcibly free it, usually will result in tearing of a portion of the sheet, or in a more severe jam requiring a complete machine shutdown as well as an expensive technical service call. Therefore to avoid such complete shutdowns, and to keep the machine functioning properly, a sheet stalled or jammed in such an interface must be withdrawn in a manner so as not to tear the sheet and not to leave torn bits and pieces of the sheet in the hidden and inaccessible sheet path.

There is therefore a need to provide apparatus for reducing a sheet, stalled across an interface between a withdrawable and a fixed module of an electrostatographic machine and gripped within a nip on each side of the interface, into a shape and size that enable the stalled sheet to be reliably removed through even a relatively narrow gap between the withdrawable and fixed components of the machine.

SUMMARY OF THE INVENTION

In accordance with the present invention, there is provided in a sheet handling machine having a frame, and a cut sheet handling system including a sheet path, a stalled sheet pulling and crushing apparatus for reducing a sheet, stalled across an interface between a withdrawable and a fixed component of a cut sheet handling system into a shape and size suitably enabling reliable removal of the stalled sheet through a relatively narrow gap between the withdrawable and fixed components of the sheet handling system. The stalled sheet pulling and crushing apparatus includes a fixed component of the sheet handling system connected to a frame of the machine and having a first sheet gripping nip forming a first section of a sheet path; a withdrawable component of the sheet handling system mounted movably to the frame, and having a sheet flattening side defining a relatively narrow gap between a fixed surface within the machine and the withdrawable component, the withdrawable component including a second sheet gripping nip forming a second section of the sheet path for adjoining the first section of the sheet path; and a movable sheet pulling device comprising a rotatable roller mounted to the fixed surface and projecting partially into the narrow gap for contacting and rotatably applying a sheet pulling force on the stalled sheet in a first direction to pull an end of the stalled sheet out of the first sheet gripping nip, as the withdrawable component is being pulled in a second and different direction relative to the first direction. The rotatable roller as mounted cooperating with the sheet crushing side of the withdrawable component to accordion fold and crush the pulled out stalled sheet without a tear, into a shape and size suitably enabling reliable removal of the stalled sheet through the narrow gap.

BRIEF DESCRIPTION OF THE DRAWINGS

Other features of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
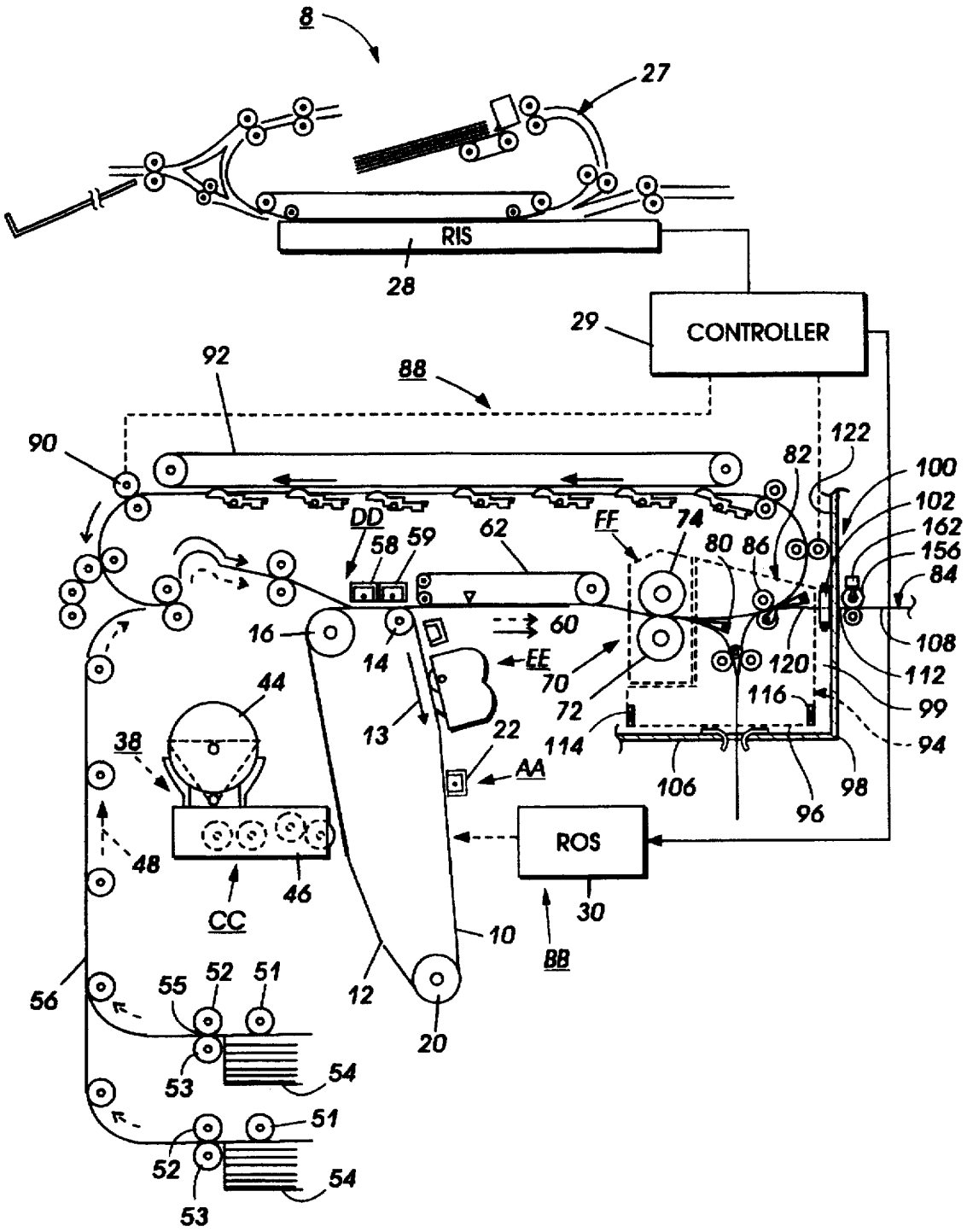
FIG. 1 is a schematic elevational view of a typical electrostatographic reproduction machine including the stalled sheet pulling and crushing apparatus of the present invention.

Referring now to FIG. 1 of the drawings, an electrostatographic reproduction machine 8 is illustrated in which an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS).

As shown, the electrostatographic reproduction machine 8 generally employs a photoconductive belt 10 that is preferably made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station AA. At charging station AA, a corona generating device indicated generally by the reference numeral 22 charges the photoconductive belt 10 to a relatively high, substantially uniform potential.

At an exposure station BB, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrostatographic reproduction machine 8 to serve as a remotely located printer for one or more computers. Alternatively, the printer may serve as a dedicated printer for a high-speed computer.

The signals from ESS 29, corresponding to the continuous tone image desired to be reproduced by the reproduction machine 8, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station DD. A print sheet 48 is advanced to the transfer station DD by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station DD to receive an image from photoreceptor belt 10 in a timed sequence so that the toner powder image formed thereon contacts the advancing sheet 48 at transfer station DD. Transfer station DD includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station FF.

As shown, at fusing station FF, a fuser assembly 70 and a single sheet inverter mechanism 82 (to be described in detail below) are mounted removably as a withdrawable module 94 on a common platform 96. Fusing station FF as shown includes the fuser assembly indicated generally by the reference numeral 70 which permanently fuses and affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

In a flawless operation with no sheet jams, the sheet passes through fuser or fuser assembly 70 where the image is permanently fixed or fused to the sheet. After passing through fuser 70, a gate 80 either allows the sheet to move directly through an output nip 86 and via an output path 84 to a finisher or stacker (not shown), or it deflects the sheet into the single sheet inverter 82, from which it then enters a duplex path 88. Specifically, if the sheet is either a simplex sheet, or a two-pass duplex sheet on its second pass from the fuser, such sheet will be conveyed via gate 80 directly to output path 84. However, if the sheet is being duplexed and it is on its first pass from the fuser on its way back for its second pass, then the gate 80 will be positioned so as to deflect that sheet into the inverter 82. From the inverter 82, it is then fed into the duplex path 88, where it is fed to acceleration nip 90 and belt transports 92. There it is recirculated back through transfer station DD and fuser 70 for receiving and permanently fixing the side two image to the backside of that duplex sheet, before it exits via exit path 84.

However, as is well known, in any electrostatographic reproduction machine 8 or sheet handling machine 8 including cut sheet handling components or modules, sheets can, and do stall. In some such machines, for example the machine 8 (FIG. 1), withdrawable components such as 94 are mounted adjacent fixed components 98 leaving only a very narrow gap 99 of about 8 mm or less between them, and through which a sheet being moved from one to the other of the two types of components must be removed if it stalls.

For example, in the machine 8 of FIG. 1, sheet jams or sheet stalls do occur with sheets being moved through the fuser assembly 70 to the output path 84, as well as with sheets being moved from the fuser assembly 70 through the inverter 82 and into the duplex path 88. A copy sheet stall or jam during either of these two movements ordinarily will result in a temporary and partial machine 8 shutdown, and in a call or alert for an operator to remove or clear the stalled or jammed copy sheet, wherever it may be. However, as pointed out above, because of the hidden nature of the sheet path, and the narrowness of the gap 99 through which the stalled sheet must be removed, ordinary attempts to remove stalled sheets frequently result in aggravated jams that end up locking or binding the withdrawable component 94 in place, thus creating a complete machine 8 shutdown and a major technical service call. In accordance to the present invention however, such aggravated jams are prevented by use of the stalled sheet pulling and crushing apparatus 100 of the present invention ( to be described in detail below).

Still referring to FIG. 1, after the print sheet is separated from photoconductive surface 12 of belt 10, the residual toner/developer and paper fiber particles adhering to photoconductive surface 12 are removed therefrom at cleaning station EE. As shown, cleaning station EE may include a rotatably mounted fibrous brush in contact with photoconductive surface 12 to disturb and remove paper fibers, and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

As further shown (FIG. 1) the various components and functions of the machine 8 are regulated by a controller 29. The controller is preferably a programmable microprocessor which can be programmed to provide various controls including for example a comparison count of the copy sheets, the number of documents being recirculated, the number of copy sheets selected by the operator, time delays, jam corrections, etc.. The control of all of the exemplary systems heretofore described may be accomplished by conventional control switch inputs from the reproduction machine 8 consoles selected by the operator. Conventional sheet path sensors or switches may be utilized to keep track of the position of the document and the copy sheets.

Figure 2:
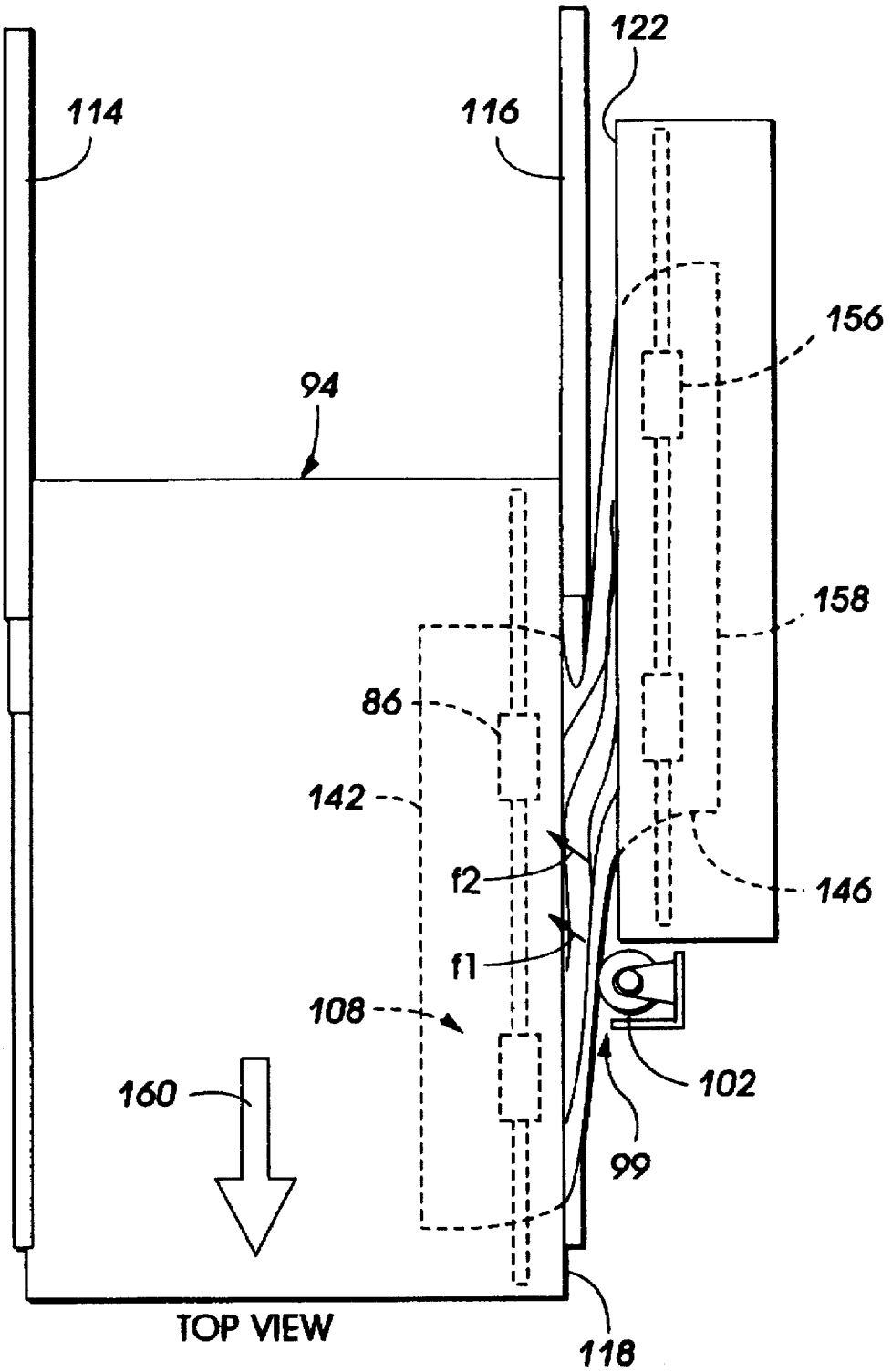
FIG. 2 is a top view illustration of the stalled sheet pulling and crushing apparatus of the present invention showing the withdrawable component partially pulled out and the stalled sheet being pulled out of the first sheet gripping nip and against the roller.
Figure 3:
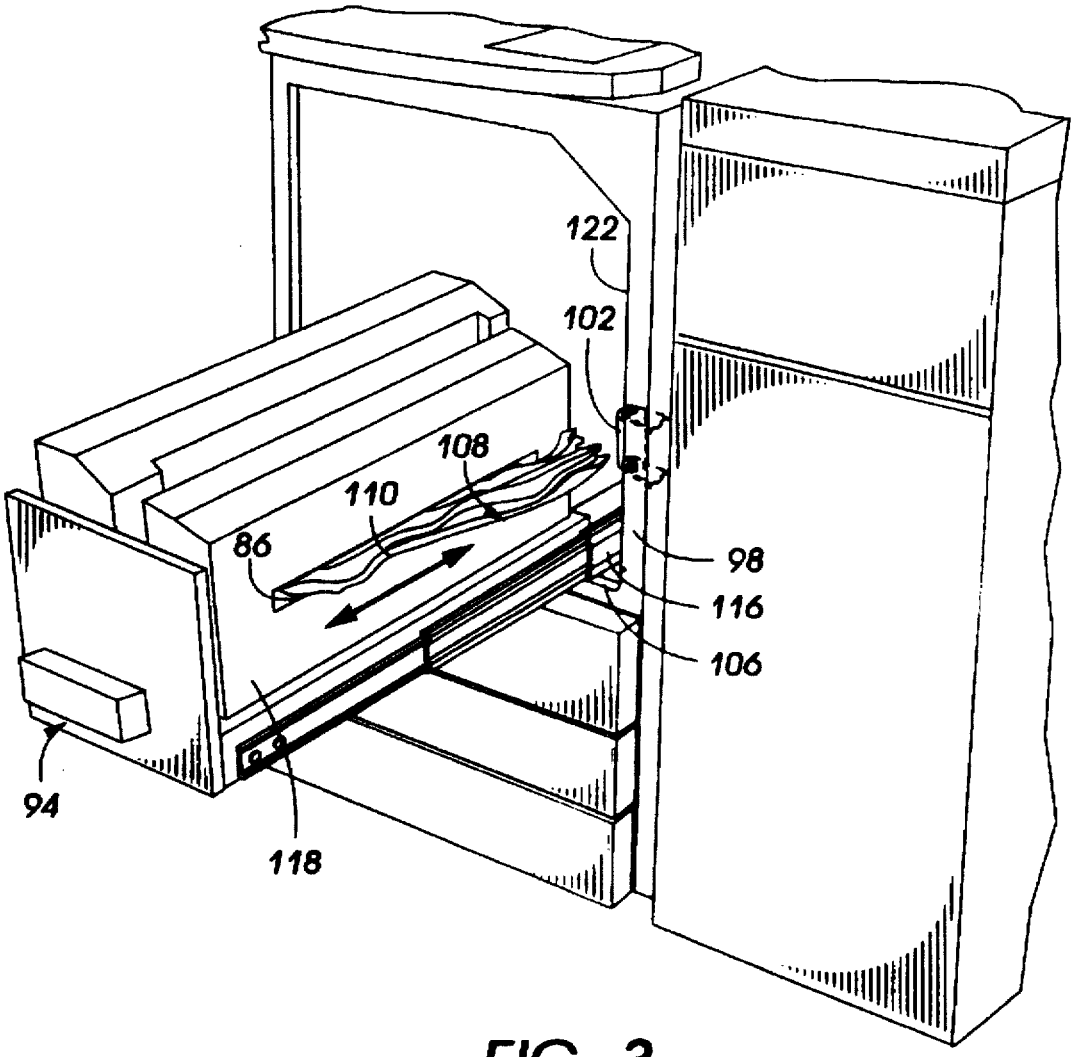
FIG. 3 is a perspective further illustration of the stalled sheet pulling and crushing apparatus of the present invention showing the withdrawable sheet handling component thereof in a pulled-out or withdrawn position with the stalled sheet completely pulled out and crushed against the sheet crushing side thereof.

Referring now to FIGS. 1 to 3, the sheet handling machine 8 has a frame 106 (shown only partially), and a cut sheet handling system comprised for example of subsystems 70, 82, 92 including a sheet path comprised for example of segments 84, 88. Importantly, the machine 8 includes the stalled sheet pulling and crushing apparatus 100 in accordance with the present invention, for reducing a sheet 108 stalled across an interface between the withdrawable and the fixed components 94, 98 respectively, and gripped within a sheet gripping nip 86, 156 on each side of the interface, into a shape and size 110 (FIG. 3) that suitably enables reliable removal of the stalled sheet 108 through even the relatively narrow gap 99 between the withdrawable and fixed components 94, 98.

As shown, the fixed component 98 can be any sheet handling module that is fixed or locked into place during the in and out movement of the withdrawable component 94. As such, the component 98 can be a portion of the frame 106 of the machine, or it could even be another component such as a sheet decurler unit. In either case, the fixed frame portion or component 98 includes a first section 112 of the sheet path at the interface between the components. The stalled sheet pulling and crushing apparatus 100 also includes a withdrawable component such as the component or module 94, which as shown, is mounted movably on rails 114, 116, to the frame 106. The withdrawable component 94 importantly includes a sheet crushing side 118 (FIG. 3) which has a second section 120 of the sheet path located such that the second section 120 adjoins the first section 112 thereof.

when the component 94 is pushed back into place within the machine. The sheet crushing side 118 and a fixed surface 122 define the relatively narrow gap 99 therebetween, within the machine. As shown (FIG. 2), a stalled sheet 108 across the interface ordinarily is gripped at each side of the interface, within a gripping nip 86, 156.

The stalled sheet pulling and crushing apparatus 100 importantly includes a movable sheet pulling device comprising a rotatable roller 102 that is mounted to the fixed surface 122, and projects partially into the narrow gap 99 for contacting and rotatably applying sheet pulling forces f1, f2 progressively to the stalled sheet. As shown, the forces fl, f2 are applied in a first direction as shown for pulling the lead end 158 of the stalled sheet out of the first sheet gripping nip 156, as the withdrawable component is being pulled in a second and different direction 160 relative to the first direction. As portions of the stalled sheet are pulled out of the nip 156, and over the rotating roller 102, the roller as mounted cooperates with the sheet crushing side 118 of the withdrawable component to progressively accordion fold and crush such portion without a tear, into a shape and size 110 suitably enabling reliable removal of the stalled sheet through the narrow gap 99.

As illustrated, the roller 102 can mounted either onto the gap-facing side of the stationary subsystem 98 or onto the machine frame 106. The roller is mounted as such so that its axis is perpendicular to, and in line with, the initial direction of operational sheet travel across the interface between the withdrawable and fixed components 94, 98 respectively. Accordingly, as the withdrawable component 94 is being pulled out, the stalled sheet 108 will be brought into contact with the surface of the roller 102, and will start to frictionally move the roller, thus moving with the roller, and eventually moving over the roller as the withdrawable component is pulled out more and more, with a trail end 142 of the sheet still within the grip of the second gripping nip 86.

Rotation of the roller as such applies a complex series of sheet pulling forces represented for example by forces fl, f2 that act progressively on the lead end 158 of the stalled sheet, gradually pulling such lead end out of the first sheet gripping nip 156. The stalled sheet 108, initially gripped at each side of the interface between the gripping nips 86, 156 instead of tearing up and further jamming within the narrow gap 99, is effectively and controllably guided, accordion folded and crushed between the roller 102 and surface 118 into a shape and size that can reliably be pulled out through the gap 99.

As shown, the roller 102 is mounted to an outboard edge of the sheet path and of the stalled sheet 108, for making contact with an edge of the sheet as the withdrawable component attempts to pull the sheet in the second direction 160. In order to make pulling of the lead end 158 easier, the apparatus 100 includes release means 162 for releasing a grip of the first gripping nip 156 on the lead end of the sheet.

It is, therefore, apparent that there has been provided in accordance with the present invention, a stalled sheet pulling and crushing apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

While the invention herein has been described in the context of an electrostatographic cut sheet using machine, it will be readily apparent that the stalled sheet pulling and crushing apparatus thereof can be utilized in any cut sheet handling machine that has a sheet handling system including withdrawable components and fixed components forming interfaces across which sheets can stall.

What is claimed is:

1. In a sheet handling machine having a frame, and a cut sheet handling system including a sheet path, a stalled sheet pulling and crushing apparatus for reducing a sheet, stalled across an interface between a withdrawable and a fixed component of a cut sheet handling system into a shape and size suitably enabling reliable removal of the stalled sheet through a relatively narrow gap between the withdrawable and fixed components of the sheet handling system, the stalled sheet pulling and crushing apparatus comprising:

(a) a fixed component of the sheet handling system connected to a frame of the machine and having a first sheet gripping nip forming a first section of a sheet path;

(b) a withdrawable component of the sheet handling system mounted movably to the frame, and having a sheet flattening side defining a relatively narrow gap between a fixed surface within the machine and the withdrawable component, said withdrawable component including a second sheet gripping nip forming a second section of the sheet path for adjoining the first section of the sheet path; and (c) a movable sheet pulling device comprising a rotatable roller mounted to said fixed surface and projecting partially into said narrow gap for contacting and rotatably applying a sheet pulling force on the stalled sheet in a first direction to pull an end of the stalled sheet out of said first sheet gripping nip, as said withdrawable component is being pulled in a second and different direction relative to the first direction, and said rotatable roller as mounted cooperating with said sheet crushing side of said withdrawable component to accordion fold and crush the pulled out stalled sheet without a tear, into a shape and size suitably enabling reliable removal of the stalled sheet through said narrow gap.

2. The stalled sheet pulling and crushing apparatus of claim 1, wherein said fixed component includes a fixed portion of the machine frame having an opening therethrough for forming a part of the sheet path.

3. The stalled sheet pulling and crushing apparatus of claim 2, wherein said rotatable roller is mounted to said fixed portion of the machine frame.

4. The stalled sheet pulling and crushing apparatus of claim 3, wherein said rotatable roller is mounted to an outboard edge of the sheet path and stalled sheet for making contact with an edge of the sheet as said withdrawable component attempts to pull the sheet in said second direction.

5. The stalled sheet pulling and crushing apparatus of claim 3, including release means for releasing a grip of said first gripping nip on the first end of the sheet, thus allowing said rotatable roller to pull the sheet therefrom by applying said sheet pulling force progressively.

* * * * *